US008024953B2

(12) United States Patent
Saito et al.

(10) Patent No.: US 8,024,953 B2
(45) Date of Patent: Sep. 27, 2011

(54) LUBRICANT FOR HOT WORKING AND METHOD FOR PRODUCING SEAMLESS STEEL PIPE

(75) Inventors: Kenichi Saito, Osaka (JP); Sumio Iida, Osaka (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 0 days.

(21) Appl. No.: 12/824,705

(22) Filed: Jun. 28, 2010

(65) Prior Publication Data

US 2010/0263422 A1 Oct. 21, 2010

Related U.S. Application Data

(63) Continuation of application No. PCT/JP2009/050129, filed on Jan. 8, 2009.

(30) Foreign Application Priority Data

Jan. 11, 2008 (JP) ..... 2008-004102

(51) Int. Cl.
*B21B 23/00* (2006.01)
*C09C 1/22* (2006.01)
*C10M 173/00* (2006.01)

(52) U.S. Cl. ..... 72/365.2; 106/456; 508/143; 508/171

(58) Field of Classification Search ..... 106/456; 508/143, 171; 72/365.2
See application file for complete search history.

(56) References Cited

U.S. PATENT DOCUMENTS

| | | | |
|---|---|---|---|
| 5,859,124 | A | 1/1999 | Yorifuji et al. |
| 5,983,689 | A | 11/1999 | Yorifuji et al. |
| 2009/0054279 | A1 * | 2/2009 | Iida et al. ..... 508/161 |

FOREIGN PATENT DOCUMENTS

| | | | |
|---|---|---|---|
| EP | 0 839 895 | A2 | 5/1998 |
| EP | 0 839 895 | A3 | 11/1998 |
| EP | 1 862 530 | A1 | 12/2007 |
| JP | 60-184410 | | 3/1984 |
| JP | 60-021111 | | 2/1985 |
| JP | 04-172112 | | 6/1992 |
| JP | 04-331292 | | 11/1992 |
| JP | 06-142749 | | 5/1994 |
| JP | 07-126684 | | 5/1995 |
| JP | 07-256328 | | 10/1995 |
| JP | 07-284817 | | 10/1995 |
| JP | 10-030097 | | 2/1998 |
| JP | 10-130687 | | 5/1998 |
| JP | 11-035967 | | 2/1999 |
| JP | 2006-219556 | | 8/2006 |
| WO | WO 2006/085599 | | 8/2006 |
| WO | WO 2007/105774 | | 9/2007 |

OTHER PUBLICATIONS

International Search Report in corresponding PCT/JP2009/050129 dated Feb. 10, 2009.
Written Opinion in corresponding PCT/JP2009/050129 dated Jan. 27, 2009 in Japanese.
Translation of International Preliminary Report on Patentability and Written Opinion for PCT/JP2009/050129, date Aug. 10, 2010.

* cited by examiner

*Primary Examiner* — Tae H Yoon
(74) *Attorney, Agent, or Firm* — Marshall, Gerstein & Borun LLP

(57) ABSTRACT

There is provided a lubricant for hot plastic working, which contains 20 to 40 mass % of iron oxide and 10 to 30 mass % of sodium silicate, wherein impurities are 3 mass % or less, and the lubricant contains 40 to 60 mass % of water. By virtue of combined action of these components, the lubricant exhibits excellent lubricity and suppliability and does not adversely affect the corrosion resistance of product. The lubricant is suitably used for lubricating a guide shoe in piercing-rolling, for example, a high-Cr steel and achieves a great effect of preventing a seizure flaw from occurring on the outer surface of product by being applied directly to the outer surface of a workpiece just before piercing rolling, preferably, within one second before starting piercing rolling.

1 Claim, No Drawings

LUBRICANT FOR HOT WORKING AND METHOD FOR PRODUCING SEAMLESS STEEL PIPE

TECHNICAL FIELD

The present invention relates to a lubricant capable of reducing friction between a workpiece and a hot working tool (hereinafter, referred simply to as a "tool") and preventing seizing in producing a seamless steel pipe by hot working. More particularly, the invention relates to a lubricant capable of reducing friction between a billet (workpiece) and a guide shoe (tool) and preventing seizing in producing a seamless steel pipe in a piercing-rolling mill. The present invention also relates to a method of producing a seamless steel pipe with the lubricant.

Unless otherwise noted, terms in this description are defined as follows:

"%" represents percent by weight of each component contained in a subject, and

"steel pipe" is a metal pipe in which the total contents of Fe, Ni and Cr are 50% or more.

BACKGROUND ART

Method of Producing Seamless Steel Pipe

A seamless steel pipe can be produced by the Mannesmann process. This process includes the steps of:

(1) piercing-rolling a billet by a piercing-rolling mill to form a blank pipe (hereinafter, referred to as a "hollow shell");

(2) elongation-rolling the hollow shell by a elongation-rolling mill (for example, a mandrel mill); and (3) sizing the elongated hollow shell by a sizing mill (for example, a stretch reducing mill).

The piercing-rolling mill is provided with a guide shoe to prevent the outside diameter of the billet from excessively increasing than expected when the billet is piercing-rolled. The piercing rolling is performed while the outer surface of billet is in contact with the guide shoe. If lubrication between the outer surface of billet and the guide shoe is insufficient, the billet may seize onto the guide shoe. As a result, not only a seizure flaw occurs on the guide shoe, but also another seizure flaw called a shoe mark occurs on the outer surface of the hollow shell.

There are two types of guide shoes: (1) a stationary plate type and (2) a rotary disc type. Both types of the guide shoes are required to prevent the above-described seizure. Therefore, sufficient lubrication between the outer surface of billet and the guide shoe is very essential.

Prior art lubricating methods are listed below.

Japanese Patent Application Publication No. 60-21111 discloses a piercing-rolling method in which a mixed coating material prepared by mixing an anti-seizure agent consisting of metal oxide powders with a binder is applied.

Japanese Patent Application Publication No. 07-126684 discloses a lubricant for hot-rolling stainless steels which contains iron oxide powders, an acrylic acid-based water-soluble polymer, and a surfactant agent.

Japanese Patent Application Publication No. 11-35967 discloses a lubricant for hot working which contains iron oxide, sodium silicate, starches, and xanthan gum.

Japanese Patent No. 2638317 describes that a lubricant for hot pipe rolling, which consists of an aqueous solution containing metal oxide powders and sodium silicate and has a viscosity of not lower than 200 cp and lower than 4000 cp, is sprayed on the surface of a heated workpiece in a hot state.

Unfortunately, when a hard-to-work material (for example, a 13% Cr steel) is pierced, the lubricants disclosed in these patent documents do not provide sufficient lubrication between the guide shoe and the hollow shell. Therefore, it is difficult for these lubricants to prevent the occurrence of a seizure flaw.

Japanese Patent Application Publication No. 07-284817 describes a method in which a lubricant prepared by mixing a solid lubricant with a swelling mica aqueous solution is supplied to between a workpiece and the guide shoe to roll the workpiece. Unfortunately, the lubricant disclosed in this patent document may boil abruptly when being applied to the workpiece, so that the lubricant may come off from the workpiece. Therefore, it is difficult, even with this lubricant, to prevent the occurrence of a seizure flaw.

DISCLOSURE OF THE INVENTION

An object of the present invention is to provide a lubricant for hot working having following characteristics:

(1) Excellent lubricity.

(2) Excellent suppliability of the lubricant to intended locations. In particular, even in the presence of scales on the surface of a workpiece, the lubricant can be supplied smoothly and adhered in a proper amount onto the surface of the workpiece.

(3) Excellent corrosion resistance maintenability, that is, even if the lubricant remains on the surface of product after working, the remaining lubricant cannot deteriorate the corrosion resistance of product.

Another object of the present invention is to provide a method of producing a seamless steel pipe with the lubricant of the present invention.

The gists of the present invention are as follows:

(I) A lubricant for hot working, comprising:

20 to 40 mass % of iron oxide; and 10 to 30 mass % of sodium silicate, wherein impurities are 3 mass % or less, and the lubricant contains 40 to 60 mass % of water.

(II) A method of producing a seamless steel pipe, wherein the lubricant for hot working according to the item (I) is applied onto the surface of a workpiece, and immediately thereafter the workpiece is hot worked.

The lubricant for hot working in accordance with the present invention achieves the following remarkable effects:

(1) Excellent lubricity (2) Excellent suppliability (3) Excellent corrosion resistance maintainability The lubricant for hot working in accordance with the present invention is excellent in lubricity, and therefore achieves a remarkable effect on preventing seizing. Further, the lubricant in accordance with the present invention is excellent in suppliability. Therefore, the lubricant can be supplied to the surface of a high-temperature workpiece and to locations which are not easy to apply the lubricant. That is, even in the presence of scales on the surface of the workpiece, a sufficient amount of lubricant can be adhered onto the very surface of workpiece, and the lubricant can be supplied to the interface between the surface of workpiece and a tool. With these effects, the lubricant in accordance with the present invention is effective as a lubricant for hot working. Especially in piercing-rolling a hard-to-work material (for example, a steel containing 8 to 25 mass % of Cr), the lubricant achieves a great effect of preventing seizure flaws from occurring on a guide shoe, further on the outer surface of product. In addition, the lubricant in accordance with the present invention is excellent in corrosion resistance maintainability. Therefore, even if the lubricant remains on the surface of product after working, the remaining lubricant does not deteriorate the corrosion resistance of product.

The excellent characteristics of the lubricant in accordance with the present invention can be exhibited sufficiently in the method of producing a seamless steel pipe in accordance with the present invention.

BEST MODE FOR CARRYING OUT THE INVENTION

Lubricant of Present Invention

A lubricant of the present invention is prepared by dispersing iron oxide in a mixture of sodium silicate and water (water glass). The iron oxide is preferably in a powder form.

The lubricant of the present invention may contain a stabilizer for stably dispersing iron oxide in addition to the above-described components. The amount of the stabilizer contained is preferably about 20 to 100 grams per 1 liter of lubricant.

In the lubricant of the present invention, impurities are likely to be mixed in the process of preparation. The impurities are exemplified by three kinds of oxides: zinc oxide (ZnO), lead oxide (PbO), and copper oxide (CuO). These three kinds of oxides exert a great influence on the performance of the lubricant of the present invention. Therefore, the upper limit of the amount of impurities in the lubricant of the present invention was defined.

The lubricant of the present invention is suitable for the production of a seamless steel pipe containing a relatively large amount of chromium, and is especially suitable for the production of a seamless steel pipe made of a steel containing 8 to 25 mass % of Cr (for example, a SUS420H equivalent steel, a SUS304 equivalent steel, and a 25Cr-based dual-phase stainless steel).

The components of the lubricant of the present invention are explained hereunder.

(1) Iron Oxide: 20 to 40 Mass %

Iron oxide is a component necessary for achieving a seizure preventive effect. Iron oxide may be any of ferrous oxide (II) (FeO), ferric oxide (III)($Fe_2O_3$), and ferrosoferric oxide(II, III) ($Fe_3O_4$). Two kinds or more of these iron oxides may be contained. The content of iron oxide in the lubricant is 20 to 40 mass %. If the content of iron oxide is less than 20 mass %, seizing may occur between a workpiece and the corresponding device member in contact with the workpiece. On the other hand, the content of iron oxide exceeding 40 mass % may be too high in comparison with the content of sodium silicate in the lubricant, and may deteriorate the suppliability of the lubricant. In this case, the lubricant becomes less prone to be brought into a work friction interface (an interface between the workpiece and a tool (for example, a guide shoe)).

(2) Sodium Silicate: 10 to 30 Mass %

Sodium silicate has a function of combining particles of iron oxide. This function makes particles of iron oxide prone to be brought into the work friction interface. Sodium silicate is an essential component for achieving this effect. The content of sodium silicate in the lubricant is 10 to 30 mass % on the basis of anhydrous. If the content of sodium silicate in the lubricant is less than 10 mass %, the suppliability of lubricant may be deteriorated, and the lubricant becomes less prone to be brought into the work friction interface. The content of sodium silicate in the lubricant exceeding 30 mass % may be too high in comparison with iron oxide, and may deteriorate the seizure preventive effect of iron oxide.

(3) Impurities: 3 Mass % or Less

Impurities are preferably smaller in amount. In the process of preparing the lubricant of the present invention, zinc oxide (ZnO), lead oxide (PbO), copper oxide (CuO), and the like are likely to be mixed concomitantly with iron oxide and the like. For example, when pickling slime in a zinc plating line or steel refining slag is used as a raw material of iron oxide, zinc oxide and the like are mixed as impurities.

If a large amount of impurities are contained, the corrosion resistance maintainability may decrease, and when the lubricant remains on the surface of product, the impurities deteriorate the corrosion resistance of product. This is because oxides in impurities are subjected to reduction reaction at high temperatures, and react with the product itself to form an alloy having poor corrosion resistance.

If the content of impurities in the lubricant is 3 mass % or less, the deteriorating effect by impurities on the corrosion resistance may be too small to be a problem. If the content of impurities in the lubricant exceeds 3 mass %, the corrosion resistance maintainability of lubricant may be decreased, and the seizure preventive effect of lubricant may also be decreased.

(4) Water: 40 to 60 Mass %

The lubricant of the present invention contains water. By making the water content in the lubricant 40 to 60 mass %, both of the suppliability and the lubricity of lubricant can be achieved. If the water content in the lubricant is less than 40 mass %, the viscosity of lubricant may increase. This makes it difficult to supply the lubricant onto the surface of the workpiece, so that the lubricity decreases. If the water content exceeds 60 mass %, a bumping boiling phenomenon (sudden vehement vaporization of water in lubricant) may occur when the lubricant is supplied and adhered onto the surface of a high-temperature workpiece. By this phenomenon, the lubricant is likely to fly apart, so that the lubricant may not remain and adhere sufficiently onto the surface of workpiece. This phenomenon occurs very often during a first piercing operation in which the temperature of workpiece is high.

As the sodium silicate and water contained in the lubricant of the present invention, water glass may be used. The water glass may be any of water glass No. 1 ($Na_2O:SiO_2=1:2$), water glass No. 3 ($Na_2O:SiO_2=1:3$), and water glass No. 4 ($Na_2O:SiO_2=1:4$).

(5) Other Components

To stably disperse iron oxide powders, a stabilizer may be added to the lubricant of the present invention. Examples of the stabilizer include: naphthalenesulforic acid soda formalin condensate, styrene/soda salt of maleic acid anhydride copolymer resin, polyacrylic acid soda salt, polyethylene glycol alkyl ether, and polyethylene glycol alkylphenyl ether.

The method of supplying the lubricant of the present invention to the surface of workpiece is not subject to any limitation. Usually, the lubricant is applied directly onto the surface of workpiece. A preferable method includes a spraying method (spraying a mist of lubricant through a nozzle) because the spraying method can provide high work efficiency and enables uniform application. Since the lubricant of the present invention is in the form of a liquid, the spraying method can be applied.

The lubricant for hot working in accordance with the present invention is excellent in lubricity. Therefore, especially in the hot piercing of a hard-to-work material, the occurrence of seizure flaws on the guide shoe as well as the occurrence of outer surface flaws of the product can be prevented. The lubricant of the present invention is also excellent in corrosion resistance maintainability. Therefore, the corrosion resistance and the like of the product are not impaired by the remaining lubricant.

The lubricant of the present invention is excellent in suppliability. Therefore, the lubricant can be supplied to the surface of a high-temperature workpiece and to locations where the lubricant cannot be readily supplied. That is, just before piercing rolling, the lubricant may be applied and adhered onto the surface of a billet (workpiece) regardless of the presence of scales, and further the lubricant can be supplied efficiently to between the workpiece and the guide shoe. Preferably, the lubricant is applied onto the surface of workpiece within one second just before the initiation of piercing rolling. By doing this, sufficient lubricity can be achieved without the lubricant being peeled off during travelling, and also even in the presence of scales on the billet surface, the lubricant may not adhere firmly to the scales, and the occurrence of outer surface flaws are prevented during piercing.

With the lubricant of the present invention being applied directly onto the surface of workpiece just before piercing rolling, the excellent characteristics of the lubricant of the present invention can be best utilized in the production of a seamless steel pipe.

EXAMPLES

Example 1

Piercing rolling using a Mannesmann piercing mill was performed by using a lubricant having a composition given in Table 1. The conditions are as follows:

Dimensions of workpiece: 225 mm in diameter, and 3000 mm in length,

Material of workpiece: billet for producing oil well pipe of 13% Cr steel,

Piercing-rolling mill: Conical roll type piercing mill

Guide shoe: disc roll having a diameter of 2800 mm and a width of 150 mm,

Hollow shell after piercing: 230 mm in outside diameter, 21.0 mm in wall thickness, and 9000 mm in length, Lubricant supplying method: spraying on workpiece surface with discharge pressure of 0.5 MPa.

Just after the lubricant had been sprayed on the surface of workpiece, piercing rolling was performed within one second.

In Table 1, "sodium silicate" was added by using water glass No. 3. The content of sodium silicate is represented on the basis of anhydrous. As "stabilizer and others", naphthalenesulforic acid soda formalin condensate, styrene/soda salt of maleic acid anhydride copolymer resin, polyacrylic acid soda salt, polyethylene glycol alkyl ether, polyethylene glycol alkylphenyl ether, and the like were added.

After piercing, the following performance was evaluated. The evaluation results are also given in Table 1.

(1) Seizing Resistance

The seizing resistance was evaluated by visually inspecting the surface of guide shoe after 50 workpieces of 13Cr steel had been pierced.

The meanings of symbols in "seizing resistance" column in Table 1 are as follows:

○: Good. Indicating that no seizing occurred.

Δ: Fair. Indicating that slight seizing occurred.

x: Poor. Indicating that significant seizing occurred in a wide range.

(2) Corrosion Resistance

The corrosion resistance was evaluated by sampling a specimen from the piercing-rolled hollow shell and by checking the absence or presence of corrosion after the specimen had been immersed in a boiling 65% nitric acid solution for 720 hours.

The meanings of symbols in "corrosion resistance" column in Table 1 are as follows:

○: Good. Indicating that no corrosion was found.

x: Poor. Indicating that corrosion was found.

(3) Adhesiveness

The adhesiveness was a property directly relating to the lubricity (seizure resistance) of lubricant used in hot plastic working, and was evaluated by visually inspecting the workpiece surface on which the lubricant had been sprayed.

The meanings of symbols in "adhesiveness" column in Table 1 are as follows:

○: Good. Indicating that no portion of poor adhesiveness was found.

Δ: Fair. Indicating that some portions of poor adhesiveness were found.

x: Poor. Indicating that lubricant was not adhered.

(4) Bumping Boiling Resistance

The bumping boiling property was evaluated by examining the absence or presence of significant vaporization of water in the lubricant (bumping phenomenon) at the time when a disc roll surface as being sprayed with the lubricant was brought into contact with a workpiece.

The meanings of symbols in "bumping boiling resistance" column in Table 1 are as follows:

○: Good. Indicating that no bumping boiling occurred.

Δ: Fair. Indicating that bumping boiling was found slightly.

x: Poor. Indicating that significant bumping boiling occurred.

If bumping boiling occurs, the lubricant flies apart, and may not adhere onto the surface of workpiece, so that the bumping boiling resistance and the adhesiveness exhibit the same tendency.

(5) Fluidity

The fluidity was a subject directly relating to whether the suppliability of lubricant was good or poor, and was evaluated how it was being discharged at the time when the lubricant was supplied to the workpiece surface by spraying.

The meanings of symbols in "fluidity" column in Table 1 are as follows:

○: Good. Indicating that the lubricant was discharged well.

Δ: Fair. Indicating that the lubricant was slightly badly discharged.

x: Poor. Indicating that the lubricant was unable to be discharged.

(5) Overall Evaluation

The overall evaluation is the evaluation result obtained by weighing all evaluations of five items as being "seizing resistance", "corrosion resistance", "adhesiveness", "bumping boiling resistance", and "fluidity". Specifically, the worst evaluation in any item among five ones becomes the "overall evaluation". For example, if the evaluation of one item among five ones is x, the "overall evaluation" becomes x even if all of other four items are ○. This is because in the case where one of five performance items evaluated by the examination is solely poor, that lubricant cannot be used at high temperatures.

The meanings of symbols in "overall evaluation" column in Table 1 are as follows:

○: Good. Indicating that all of five items are ○.

Δ: Fair. Indicating that all of five items are ○ or Δ.

x: Poor. Indicating that any one of five items is x.

TABLE 1

| | | Test No. | | | | | | | | | | |
|---|---|---|---|---|---|---|---|---|---|---|---|---|
| | | Comparative Example | | | | | | | Inventive Example | | | |
| | | 1 | 2 | 3 | 4 | 5 | 6 | 7 | 1 | 2 | 3 | 4 |
| Component (mass %) | Iron oxide | * 15.0 | * 45.0 | 30.0 | 20.0 | 30.0 | 40.0 | 20.0 | 30.0 | 35.0 | 30.0 | 25.0 |
| | Sodium silicate | 15.0 | 10.0 | * 5.0 | * 35.0 | 15.0 | 20.0 | 10.0 | 15.0 | 15.0 | 25.0 | 15.0 |
| | Impurities (ZnO, PbO, CuO) | 1.0 | 1.0 | 1.0 | 1.0 | * 5.0 | 1.0 | 1.0 | 1.0 | 1.0 | 1.0 | 1.0 |
| | Stabilizer and others | 2.0 | 2.0 | 2.0 | 2.0 | 2.0 | 2.0 | 2.0 | 2.0 | 2.0 | 2.0 | 2.0 |
| | Water | * 67.0 | 42.0 | * 62.0 | 42.0 | 48.0 | * 37.0 | * 67.0 | 52.0 | 47.0 | 42.0 | 57.0 |
| Test result | Seizing resistance | x | Δ | x | x | ○ | Δ | x | ○ | ○ | ○ | ○ |
| | Corrosion resistance | ○ | ○ | ○ | ○ | x | ○ | ○ | ○ | ○ | ○ | ○ |
| | Adhesiveness | x | ○ | Δ | ○ | ○ | ○ | x | ○ | ○ | ○ | ○ |
| | Bumping boiling resistance | x | ○ | Δ | ○ | ○ | ○ | x | ○ | ○ | ○ | ○ |
| | Fluidity | ○ | Δ | ○ | x | ○ | Δ | ○ | ○ | ○ | ○ | ○ |
| | Overall evaluation | x | Δ | x | x | x | Δ | x | ○ | ○ | ○ | ○ |

Note)
* mark indicates that the value is out of range specified in the present invention.

Table 1 reveals the facts described below.

All of Inventive Examples 1 to 4 meet the specifications of the present invention. Therefore, the overall evaluations thereof were good (○ symbol). All of these lubricants provide excellent performance.

In Comparative Example 1, the content of iron oxide was lower than the content specified in the present invention, and the content of water exceeded the specified range of the present invention. Therefore, bumping boiling occurred, the lubricant did not adhere onto the surface of workpiece, and the seizure preventive effect was not found.

In Comparative Example 2, the content of iron oxide was more than the content specified in the present invention. Therefore, the fluidity was slightly poor, and the lubricant was hindered from adhering smoothly onto the interface between the workpiece and the guide shoe. As a result, slight seizing occurred.

In Comparative Example 3, the content of sodium silicate was lower than the content specified in the present invention, and the content of water exceeded the specified range of the present invention. Therefore, slight bumping boiling occurred, and the adhesiveness deteriorated. As a result, seizing occurred in a wide range.

In Comparative Example 4, the content of sodium silicate exceeded the content specified in the present invention, and was relatively excessive in comparison with the content of iron oxide. Therefore, the seizure preventive effect, which is to be achieved by iron oxide, deteriorated.

In Comparative Example 5, the content of impurities exceeded the specified range of the present invention. Therefore, corrosion occurred in the corrosion resistance test.

In Comparative Example 6, the content of water was slightly less than the specified range of the present invention. Therefore, the fluidity deteriorated, and seizing occurred.

In Comparative Example 7, the content of water exceeded the specified range of the present invention. Therefore, bumping boiling occurred, the lubricant did not adhere onto the surface of workpiece, and seizing occurred in a wide range.

Example 2

How the effects of lubricant are affected by the duration of time from applying the lubricant onto the workpiece surface to starting piercing rolling was confirmed.

After the application of the lubricant of Inventive Example 1 given in Table 1 onto the workpiece surface, the duration of time therefrom to starting piercing rolling was changed. Other conditions were the same as those of Example 1. The lubricity (the same evaluation as "seizing resistance" in Example 1) and the occurrence of outer surface flaws of a workpiece (hollow shell) were examined.

Table 2 gives the examination results.

The meanings of symbols in "lubricity" column in Table 2 are as follows:

○: Good. Indicating that no seizing occurred.

Δ: Fair. Indicating that slight seizing occurred.

x: Poor. Indicating that significant seizing occurred in a wide range.

The meanings of symbols in "outer surface flaw" column in Table 2 are as follows:

○: Good. Indicating that no flaw occurred.

Δ: Fair. Indicating that some flaws occurred.

x: Poor. Indicating that many flaws occurred.

TABLE 2

| | Duration of time from application to starting piercing rolling | | |
|---|---|---|---|
| Evaluation item | 0 to 1 sec | Exceeding 1 sec and not exceeding 60 sec | Exceeding 60 sec |
| Lubricity | ○ | Δ | X |
| Outer surface flaw | ○ | Δ | X |

Table 2 reveals the facts described below.

When the duration of time from the spray application of the lubricant onto the workpiece surface to starting piercing rolling was 0 to 1 second, examination results of both lubricity and outer surface flaw were good. On the other hand, when the time to starting piercing rolling exceeded 1 second, examination results of both lubricity and outer surface flaw showed a tendency toward worsening, and when the time exceeded 60 seconds, the lubricity deteriorated, and many flaws occurred on the outer surface of hollow shell.

INDUSTRIAL APPLICABILITY

The present invention can be used effectively for the production of hot worked seamless steel pipes.

The invention claimed is:

1. A method of producing a seamless steel pipe, comprising the steps of:

applying a lubricant for hot working onto the surface of a workpiece, said lubricant comprising 20 to 40 mass % or iron oxide, 10 to 30 mass % of sodium silicate, 3 mass % or less of zinc oxide (ZnO), lead oxide (PbO), and copper oxide (CuO), and 40 to 60 mass % of water;

and hot working the workpiece within one second after the applying step.

* * * * *